US005413814A

United States Patent [19]

Bowen et al.

[11] Patent Number: 5,413,814

[45] Date of Patent: May 9, 1995

[54] TECHNIQUES FOR COATING ARTICLES TO HAVE THE APPEARANCE OF WOOD, LEATHER OR OTHER NATURALLY OCCURRING MATERIALS

[76] Inventors: Robert L. Bowen, 42 W. Lynwood Blvd., Hillsdale, Mich. 49242; Manuel C. Turchan, 42288 Crestview, Northville, Mich. 48167

[21] Appl. No.: 212,904

[22] Filed: Mar. 15, 1994

[51] Int. Cl.[6] ..... B05D 1/36; B05D 5/00

[52] U.S. Cl. ..... 427/262; 118/44; 118/669; 118/671; 427/264; 427/265; 427/267; 427/270; 427/271

[58] Field of Search ..... 427/262, 264, 265, 267, 427/270, 271; 118/44, 669, 671

[56] References Cited

U.S. PATENT DOCUMENTS

| | | | |
|---|---|---|---|
| 3,772,110 | 11/1973 | Brown | 156/73 |
| 4,103,056 | 7/1978 | Baratto et al. | 428/142 |
| 4,830,929 | 5/1989 | Ikeda et al. | 428/542.8 |
| 5,075,052 | 12/1991 | Malvassora | 427/267 X |
| 5,075,059 | 12/1991 | Green | 264/129 |
| 5,089,313 | 2/1992 | Cope | 427/267 X |
| 5,302,204 | 4/1994 | Hayslip | 427/424 X |

*Primary Examiner*—Michael Lusignan
*Attorney, Agent, or Firm*—Gerald E. Linden

[57] ABSTRACT

Articles, such as plastic parts, having the appearance of a naturally-occurring material such as wood or leather are formed by the techniques of (1) providing a plurality of grooves in a surface of the article, (2) applying a surfactant to the surface of the article, and (3) applying one or more color solutions to the surface of the article. The article may be a solid substrate, a part or a film. A topcoat is preferably applied to the surface of the article. The techniques include controlling movement of an applicator implement for applying the surfactant and color solutions to the surface of the substrate, and controlling movement of a saturator tool for modifying and synthesizing the surfactant and color solutions on the surface of the part and permeating the surfactant and color solutions into the plurality of grooves.

47 Claims, 3 Drawing Sheets

TECHNIQUES FOR COATING ARTICLES TO HAVE THE APPEARANCE OF WOOD, LEATHER OR OTHER NATURALLY OCCURRING MATERIALS

TECHNICAL FIELD OF THE INVENTION

The present invention relates to techniques for coating an article, such as a plastic (synthetic) article, to have an altered appearance, such as the appearance of naturally-occurring materials such as wood, leather, etc. In the main hereinafter, coating a plastic article to have the appearance of wood is discussed.

BACKGROUND OF THE INVENTION

Consumers generally rely on the aesthetic appearance of a product to evaluate quality and value. Aesthetic properties may be utilized as a means for conveying to consumers superior value and/or quality. Real wood, for example, portrays genuineness and authenticity. Simulated wood finishes (e.g., coatings) on non-wood products attempt to capitalize on this consumer attraction.

Industries that use real wood include automotive (e.g. recreation vehicles, luxury vehicles, sport vehicles, van conversions, and trucks), marine, building, home interior, furniture, sporting articles, and entertainment. For example, the automotive and marine industries typically utilize real wood, such as walnut, maple, oak, cherry, teak, mahogany, birch, or zebrano, for various articles such as decking and trim components.

Purchasing a product utilizing real wood provides appealing aesthetic appearance, suggests quality, and is perceived to have high value. However, real wood components generate the following concerns—limited flexibility in design and assembly, slow manufacturing and installation processes, high cost, not flexible (i.e., most woods are relatively rigid), may be unsafe in certain applications, splinter on impact, not fireproof, and environmental waste.

Commercially and economically manufacturing "synthetic" (ersatz) wood articles having superior aesthetic appearance, strength, and durability, is increasingly becoming desirable. Plastic synthetic wood is an alternative to real wood. It is desirable to have plastic synthetic wood that will (1) provide viable alternatives to real wood as a means for conveying to the consumer value and/or quality in a product or service, and (2) reduce or overcome the above-mentioned concerns incident to using real wood.

The following U.S. patents, incorporated by reference herein, are exemplary of the prior art methods for making synthetic wood:

(1) U.S. Pat. No. 3,772,110 ("Method For Construction Of Plastic Enclosure")—pertains to phonograph consoles and glaze coating;

(2) U.S. Pat. No. 4,103,056 ("Resilient Wood Replication")—pertains to floor tiles and stain coat;

(3) U.S. Pat. No. 5,075,059 ("Method For Forming Panel Door With Simulated Wood Grains")—pertains to panel doors and compression molding and stain; and (4) U.S. Pat. No. 4,830,929 ("Molded Wooden Products")—this invention pertains to wood products formed by molding fibers under compression—conventional molded wooden products are manufactured by hot-press shaping methods in which a mat comprised of wood fibers is pressed and shaped under heat.

The above-referenced U.S. Pat. No. 4,103,056 discloses a method for constructing phonograph consoles from a series of all plastic panels which have been injection molded to very closely resemble the surfaces of master wooden panels. In this patent, "it is important as the initial step required for manufacturing plastic panels, to obtain a wooden panel that may serve as a master." Also, this master wooden panel will have a "wood grain which is aesthetically attractive and which the manufacturer desires to reproduce in appearance on a plastic cabinet." The grain in the master wooden panel will define (e.g., limit) the grain appearance on the plastic panels which have been injected molded. The outer surface of the plastic panel is sprayed with a glaze containing a fine filler. The "glaze is wiped off the panels in a such a manner as to leave light and dark streaked areas which simulate highlighting of actual wood and also to leave dark grain areas where the glaze has clung in the tiny grain-like crevices." A disadvantage of the technique disclosed in this patent includes restrictions of wood grain appearance and texture to that of the master wood panel. Further, it is necessary to have a separate (different) mold prepared for each different wood grain desired. Also, this technique requires that (1) the glaze contains a filler to fill in the plastic grain texture molded from the master wooden panel and (2) excess glaze be removed therefrom.

Although attempts have been made to make synthetic wood, there remain several disadvantages and shortcomings in the prior art. Prior art synthetic wood articles generally have high cost, inefficient manufacturing processes, require a "master" wooden panel, are limited in control over grain, texture, and color appearance, are limited in their application, tend to overemphasize the appearance of real wood, appear artificial, and/or utilize wood fibers.

What is needed is an inexpensive, commercially useful, and versatile process for making plastic synthetic wood imparting captivating aesthetic appearance of any desired grain, texture, and coloring. Furthermore, it is desirable to have a process for making more than one grain pattern, texture, and color, without necessitating extensive changes. It is further desirable to have a plastic synthetic wood having a favorable aesthetic appearance, desired strength, impact resistance, and flexibility. It is further desirable to have a plastic synthetic wood with design flexibility, ease of assembly, and durability exceeding that of real wood. It is further desirable to have a plastic synthetic wood having desired aesthetic appearance that is suitable for indoor and/or outdoor applications. Furthermore, it is desirable to have a thin film (veneer) having the appearance and/or texture of real wood.

SUMMARY OF THE INVENTION

It is an object of the present invention to provide an improved technique for fabricating a coating on an article, such as a plastic (synthetic) article, the coating imparting an altered appearance to one or more surfaces of the article, the altered appearance including (1) the appearance of a naturally-occurring material (such as wood or leather), and (2) an arbitrary and fanciful (unnatural) appearance to the one or more surfaces of the article.

It is another object of the present invention to provide a process for making plastic articles having the appearance of a wood, leather, or other naturally-occurring materials.

It is another object of the present invention to provide a process for making a plastic article having at least one of a desired wood grain, color, and texture.

It is a further object of the present invention to provide a process for making a plastic article capable of having more than one desired wood grain, color, and texture from one underlying surface texture.

It is a further object of the present invention to provide a process for making a plastic article having high impact resistance and strength, and having a controllable rigidity ranging from relatively rigid to relatively flexible.

It is a further object of the present invention to provide a technique for making plastic articles having the appearance of naturally-occurring articles using a variety of processes, including injection molding, profile extrusion molding, vacuum forming, thermoforming, thermosetting, blow molding (including extrusion blow molding and injection blow molding), sheet extrusion, casting, and the like.

According to an embodiment of the present invention, a method for imparting a desired (altered) aesthetic appearance to an article comprises the steps of applying a surfactant solution (e.g., water, or other suitable wetting or diluting agent) and a color solution to one or more textured surfaces of an article (e.g., a plastic article), to achieve a desired grain, hue or tone, and texture on the surface(s) of the article. (It is understood that the article has an "inherent" underlying color )

In an embodiment of the present invention, a method for making plastic synthetic wood having desired aesthetic appearance comprises the steps of:

(1) preparing an article (e.g., plastic part) to have a predetermined surface texture, substrate color (inherent color of the article), and shape, the part having desired durometer "D" and thickness "t";
(2) applying a surfactant solution on the surface of the part;
(3) applying at least one color solution on the surface of the part;
(4) adjusting the amount of surfactant and color solutions on the surface, and causing the surfactant and color solutions to permeate the surface (especially the surface texture) by moving a saturator implement along the surface of the part at sufficient speed and pressure to adequately saturate and synthesize the surfactant solution, the color solution, the substrate color, and the surface texture to generate a desired grain, hue or tone, and/or texture.

A mold may be utilized for defining the shape and surface texture of a desired plastic part. A plastic part is, for example, injection molded so as to generate a predetermined surface texture, substrate composition, substrate color, and shape. Three-dimensional laser material processing may also be used to produce a predetermined surface texture and part shape. Embossing techniques may also be used to produce a predetermined surface texture.

The textured surface should have predetermined groove characteristics (area and spacing) so as to permit effective saturation (e.g., of surfactant and color solutions), produce desired concentration, and achieve a desired hue or tone. This is achieved by adequately controlling the pressure, speed, and movement of the applicator implement, as well as by the saturator and the groove characteristics.

The composition of an article (e.g., plastic substrate) to be coated must be such that it is suitable for receiving and adhering a base coat composition. The substrate has a predetermined color so as to generate a desired aesthetic tone or hue. This aesthetic tone or hue is achieved by adequately applying and saturating the color solution, surfactant solution, and substrate.

The surface of the part will have a predetermined texture. This texture will have irregularly spaced grooves, each groove having a predetermined pattern. The texture of the plastic part, in addition to the substrate color, color solution, and surfactant solution, facilitate for achieving any desired grain, color, or texture.

The surfactant solution preferably comprises distilled and deionized $H_20$ blended with sufficient amount of methyl ethyl ketone peroxide (MEKP). The color solution is preferably water based paint (or ink). Color solution may include Brown, Red, Black, or any other color to achieve a desired effect.

An applicator implement (tool, mechanism) is used to apply the surfactant and color solution(s) on the surface texture of the part. A saturator implement (tool, mechanism) is used to saturate and synthesize the surfactant solution, color solution, substrate color, and surface texture so as to generate the desired aesthetic appearance (e.g. grain, hue or tone, and texture).

Predetermined combination of colors (color solution and substrate color), with appropriate surface texture and sufficient surfactant solution, facilitates for generating any desired grain, hue or tone, and texture.

The applicator and saturator are important mechanisms for obtaining the desired aesthetic appearance.

A means for controlling the pressure, speed, direction, and pattern of the applicator and saturator implements is desirable. The applicator and saturator may be controlled manually or automatically. In an automated processing system, a multi-axis, computer-controlled, positioning mechanism may be utilized. This mechanism will receive adequate parameters generating a desired grain, hue or tone, or texture.

After the coating is completed, the substrate is placed in a curing station. Following this phase, a top coat (protective or decorative coat) may be applied. This top coat can provide a desired gloss (or matte finish) on the completed part.

The plastic part preferably includes means for attaching the part to another surface, such as holes for screws or nails, snaps, double sided tape, and staples.

The automated techniques of the present invention allow for high volume production of coatings on articles. It should be understood that the process can also be performed manually.

The techniques of the present invention allow for combinations of surface appearances in different areas of an article. For example, one area of an article can be made to appear like wood, while another area of the article can be made to appear like leather, both of which are examples of naturally-occurring materials.

Employing the techniques of the present invention, a coating can be applied to virtually any article. For example, a plastic article can be coated, on one or more surfaces of the article, to have the appearance of wood, leather or the like. However, the invention is not limited to coating plastic articles, nor is it limited to simulating the appearance of naturally-occurring materials. For example, a metal (such as steel) article can be coated to have an "un-natural" (fanciful and arbitrary) appearance, in which case the surface texture can be imparted by any suitable mechanism such as wet etching, dry etching, etc. Using appropriate implements, fingernails could also be coated, to have either a natural or an un-natural (fanciful and arbitrary) appearance. In this case, surface irregularities naturally occurring in fingernails can be advantageously employed (e.g., rather than advertently creating a surface texture on the article—in this case the fingernail).

Other objects, features and advantages of the invention will become apparent in light of the following description thereof.

DETAILED DESCRIPTION OF THE INVENTION

The present invention discloses method and apparatus for fabricating and coating articles (such as plastic synthetic articles), including parts and films, having the appearance and/or texture of genuine, naturally-occurring materials such as wood and/or leather, or having an arbitrary and fanciful appearance. Generally, naturally-occurring materials exhibit a grain (observable surface irregularities, e.g., due to cell structure) and/or uneven coloring that is generally not present in "ordinary" plastic articles (which tend to have a relatively smooth surface lacking graininess and which tend to exhibit uniform coloration). In the main hereinafter, techniques for fabricating plastic articles (e.g., parts and films) having the appearance of wood are discussed.

Figure 1:
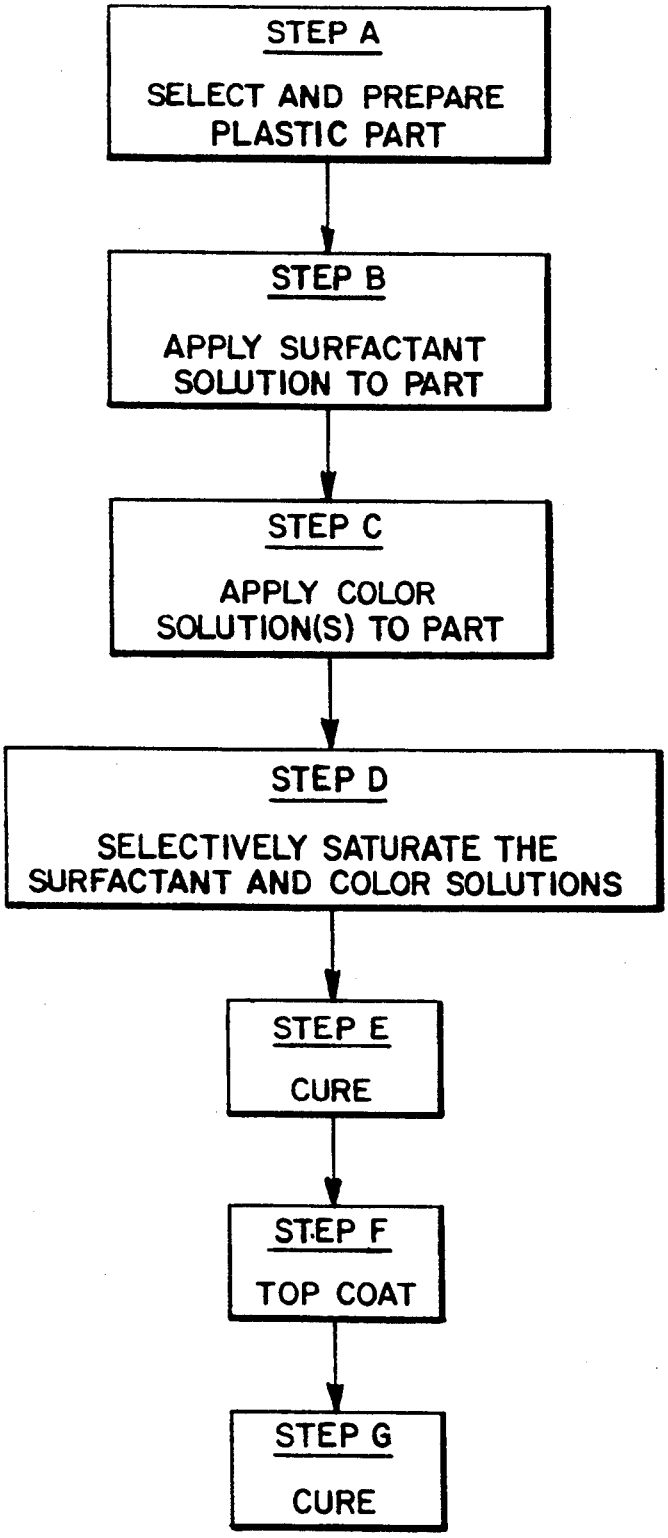
FIG. 1 is a process flow diagram illustrating an embodiment of the technique of the present invention.

FIG. 1 is a diagram showing an embodiment of the process steps for making plastic articles according to the present invention.

In a first process step (Step A), a plastic article (part) is fabricated, such as by molding or the like, to have a predetermined color, shape, durometer and/or thickness. The color of the part may be inherent (e.g., the color of the plastic), or may be a "base" color applied to the part, such as with paint or dye.

In the fabricating of the part, or in post-fabrication steps, at least one surface of the part is provided with grooves (surface irregularities), preferably mimicking the graininess of a naturally-occurring material (such as wood or leather). This may be on the front surface of a two-sided substrate, on one or more edges of the part, or in the walls of holes extending into or through the part. In the main hereinafter, treating (coating; altering the appearance of) the front surface of a substrate to emulate (mimic) the appearance of a naturally-occurring material is discussed. However, it should be understood that the technique of the present invention is applicable to any and all surfaces of an article (the part).

As described hereinbelow, distinct areas of the substrate may be provided with distinct (different) groove patterns, each of which mimics a particular naturally-occurring material. For example, one area of the substrate can be grooved to have a surface texture mimicking a wood grain (e.g., such as parallel lines or line segments), and another area of the substrate can be grooved to have a surface texture mimicking a leather grain (e.g., such as irregular diamonds).

In a next process step (Step B), an applicator implement (tool) is used to apply a wetting agent (such as water, hereinafter "surfactant solution") on the front (e.g., grooved) surface of the substrate. Generally, this involves moving a wetted applicator implement across the front surface of the part, the appearance of which is desired to be altered.

In a next process step (Step C), the applicator (or another implement) is used to apply at least one color solution to the front surface of the substrate.

In a next process step (Step D), a saturator implement is used to adequately remove and/or saturate the surfactant solution and the at least one color solution in a manner that will adequately saturate and synthesize the surfactant solution, the at least one color solution, the substrate color, and the grooves on the front surface.

After the coating is completed, the coated part is cured, such as by heating and/or air-drying. This is indicated by the process step (Step E).

Next, in a process step (Step F), a suitable top coat (protective or decorative coat) may be applied to the part so as to provide a desired finish (e.g., glossy, matte, etc) to the part. Certain top coat compositions will require curing, in a process step (Step G).

A suitable top coat includes a flexible water or solvent based coat, such as water-based, urethane, epoxy and acrylic, and may be applied in any suitable manner, such as with a brush, with a rag, with a roller, by spraying onto the substrate, etc.

The completed (optionally base-coated, coated, and optionally top-coated) plastic part, having the appearance of a naturally-occurring material, is useful for a plethora of applications, including uses as a trim item for automotive uses, sporting equipment, furniture, and the like. To the end of using the completed plastic part as a trim item, means for attaching the completed plastic part to another, existing structure is provided. This includes holes through (or on the back, unfinished side of) the completed part for receiving screws, snaps integrated into the part, double-sided tape, holes for receiving nails or staples, etc.

Figure 2:
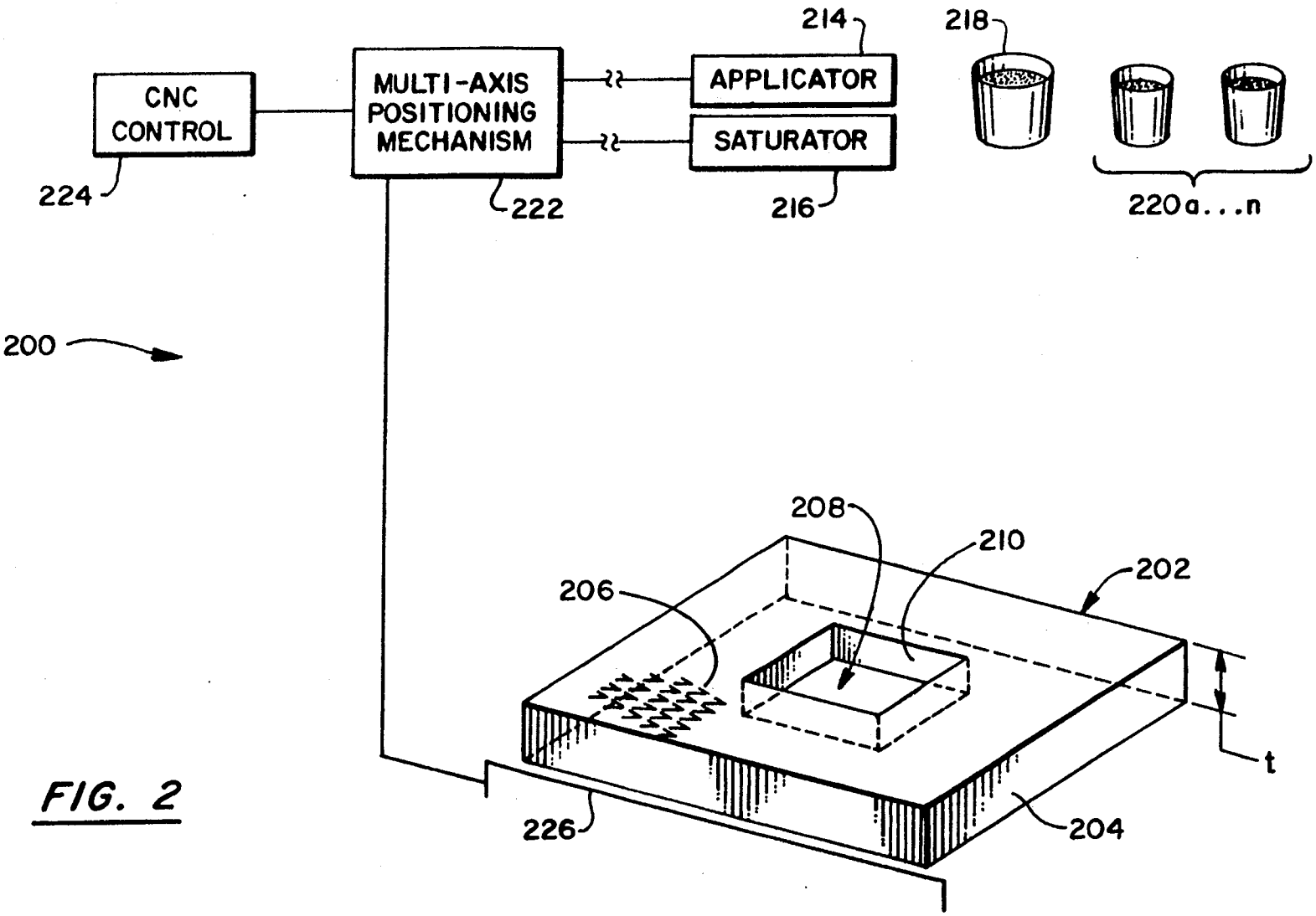
FIG. 2 is a partially schematic representation, partially perspective view, of an embodiment of a process for coating an article, according to the present invention.

FIG. 2 is a block diagram of an embodiment of a system 200 for automated implementation of the techniques of the present invention. In an exemplary embodiment of the present invention, a method for making plastic synthetic wood having a desired aesthetic appearance comprises the steps of:

(1) preparing a plastic part 202 having a predetermined surface texture 206 (indicated by marks ">" on the surface of the substrate), color and shape, the part 202 having a desired durometer "D" and a thickness "t";

(2) controlling movement of an applicator implement 214 to apply surfactant solution from a reservoir (of surfactant solution) 218 on the textured surface of the part 202;

(3) controlling movement of the applicator implement 214 to apply at least one color solution from at least one reservoir 220*a* . . . 220*n* on the textured surface of the part 202;

(4) controlling movement of a saturator implement 216 to selectively move the coloring fluid around the surface of the part 202 and to control the thickness or density of the color solution(s) on the surface of the part 202, including permeating the grooves 206 and, if desired, clearing the ungrooved portion of the surface of surfactant and color;

(4a) optionally, the saturator can be wetted with a catalyst, or the like (not shown) prior to moving the color solution(s) around the surface of the part 202.

Generally, the saturator implement 216 is used to control the thickness, density and placement of the color solution(s) on the surface of the part 202 including, but not limited to causing the color solution(s) to permeate the grooves in the surface of the part 202 and/or removing the color solution(s) from certain areas of the part 202.

Generally, the saturator implement 216 is caused to progress (move in a predefined path) along the surface of the part at sufficient speed and pressure to adequately saturate and synthesize the surfactant solution, the color solution(s), optional substrate base coat color, all vis-a-vis the surface texture to generate a desired grain, hue or tone, and/or texture on the surface of the part.

Molding apparatus (not shown), or the like, may be utilized for defining the shape and surface texture of the plastic part 202. For example, the plastic part may be injection molded to define, in-process, the desired surface texture (e.g. 206), composition, color, and shape.

Alternatively, the part may be molded (or the like) to have a smooth surface, and be post-processed to have a non-smooth surface texture. For example, three-dimensional laser material processing equipment (not shown) may also be used to produce a predetermined surface texture. Other examples for producing a predetermined surface texture include embossing or coining dies techniques. In other words, an initially smooth surface on a plastic part can be post-processed (e.g., after molding, or the like) to exhibit the desired surface texture.

Preferably, the surface texture (e.g., 206) imparted to the surface of the part (e.g., 202) comprises a predetermined pattern of a plurality of grooves, wherein the dimensions (including depth, length, width) of each groove, as well as their spacing and location on the surface of the part being are controlled.

The configuration of the grooves on the surface of the part plays an important role in permitting effective saturation of the coloring solution into the surface of the part, including producing a desired concentration, and achieving a desired hue or tone. The interaction of the applicator and saturator implements on the surface of the part also play an important role in this important function. More particularly:

(1) in a gross sense, the applicator implement is caused to apply a desired quantity of surfactant solution and color solution to the surface of the part; and (2) in a more subtle sense, the pressure, speed, and movement of the applicator and saturator implements on the surface of the part are controlled to influence the application of surfactant and color solutions to the surface of the part.

Generally, the plastic substrate composition (material) of the part 202 must be suitable for receiving and sufficiently adhering the surfactant and color solutions (as well as the optional base coat applied to the part).

The coating, having a desired aesthetic tone or hue, is achieved by adequately applying and saturating the surfactant solution, color solution(s), and inherent (underlying) substrate color 214.

Preferably, the surface of the part is provided with predetermined, irregularly-spaced grooves, each groove having predetermined length, width, and depth. The surface texture of the part, in addition to the substrate color and color solution(s), facilitate creating any desired aesthetic grain, color, or texture (e.g., walnut, oak, cherry, maple, birch, and mahogany) on the surface of the part.

Suitable surfactant solutions include distilled and deionized water ($H_2O$), preferably mixed with methyl ethyl ketone peroxide (MEKP) .

Suitable color solutions include water-based paint (or ink). Suitable colors for the color solutions include brown, red and black, or any other color simulating the appearance (when applied to a substrate according to the techniques of the present invention) of a naturally-occurring material.

The applicator instrument (214) is used to apply the surfactant solution and color solution(s) on the surface of the part (202). The saturator (216) is used to saturate and synthesize the surfactant solution, color solution, substrate color, and surface texture to generate the desired aesthetic appearance.

The applicator (214) may be of any suitable form or material which is capable of adequately (1) applying surfactant solution and the color solution, and (2) directing the surfactant solution and the color solution at the surface and grooves to generate a desired concentration or effect.

The saturator (216) may be of any suitable form or material suitable for controlling the saturation and synthesis of surfactant solution, color solution, and substrate color. The saturator 206 may be of any material which (1) is capable of sufficiently saturating surfactant solution, color solution, and substrate color, and (2) generating a desired concentration of the solutions throughout the part, and developing a desired aesthetic appearance. The saturator is preferably pre-wetted with sufficient surfactant solution to accomplish these functions.

The saturator implement can be applied to the surface of the part to remove most or all of the surfactant and color solutions from the surface of the substrate, while permeating the surfactant and color solutions into the grooves in the surface of the substrate. Preferably, however, instead of removing the color solution from the surface of the part, the saturator will sufficiently integrate and synthesize the surfactant solution, color solution, substrate color, and surface texture. Whereas prior art techniques generally involve applying and removing a stain from a surface, the current invention involves effectively saturating and synthesizing a surfactant solution (e.g., 218), color solution (e.g., 220*a* . . . n), and substrate color, on a surface texture, to achieve a desired grain, hue or tone, texture, and grain pattern effect.

The applicator 214 and saturator 216 are important mechanisms for obtaining the desired aesthetic appearance. Generally, the applicator and the saturator should be formed of a material having pores suitable for adequately saturating and synthesizing the surfactant solution, the color solution, the substrate color, and the surface texture to generate a desired grain, hue or tone, and/or texture. It has been found that either polyester foam or polyurethane foam are suitable materials for the applicator and saturator implements.

A mechanism for controlling the pressure, speed, direction, and pattern (across the surface of the substrate) of the applicator and saturator implements is necessary for automating the process.

As shown in FIG. 2, in an automated processing system, a multi-axis, computer-controlled positioning mechanism 222 may be utilized to control the movement and interaction (with the substrate) of the applicator and saturator implements. This mechanism 222 receives pre-programmed parameters from a control system (e.g., a CNC system) 224 generating a desired grain, hue or tone, or texture.

The mechanism 222 may also be used to control a fixture 226 suitable for receiving the part 202. In this manner, mechanism 222 may be used to control applicator 214, saturator 216, and/or fixture 226.

A feature of the present invention is that the grooves can be formed, and the applicator and saturator implements controlled, and the color solutions selected, to achieve virtually any desired appearance on the finished product. This includes generating random grain and color patterns, repeating patterns, non-repeating patterns, and the like on plastic parts produced in the same mold or having identical topographical features.

Predetermined combination of colors (color solution(s) and substrate color), with appropriate surface texture and surfactant solution, facilitates generating any desired grain, hue or tone, and texture.

The tone or hue generated according to the presented invention provides aesthetic appearance of substantially any desired wood, including walnut, maple, oak, cherry, teak, mahogany, or birch.

Exemplary uses of completed plastic parts, fabricated according to the present invention, include functional components and non-functional components. For example, non-functional plastic synthetic wood components for use in the van conversion and truck industry include the following: instrument panel bezel, glove box bezel, ash tray bezel, ash tray cover, radio bezel, and passenger trim.

The completed plastic parts, fabricated according to the techniques of the present invention comply with automotive standards pertaining to humidity resistance, mar resistance, weatherometer exposure, fadeometer exposure, impact resistance, acid resistance, soap and water resistance, cycle crack resistance, naphtha resistance, flexibility, and adhesion.

The (optional) base coat of the present invention will adhere tightly to the part, and will not peel, flake, crack or powder from the part, or lose color or gloss.

The completed plastic parts fabricated according to the techniques of the present invention are useful for either indoor or outdoor applications.

As shown in FIG. 2, the technique of the present invention is useful for coating one or more edges 204 of the part 202, as well as coating the sidewalls 210 of a hole (or depression) 208 in the part 202. Virtually any portion of any geometry part can be coated according to the techniques disclosed herein, including coating different portions of the part in different manners.

Exemplary uses include:

1. coating plastic, including thermal plastic, elastomers, nylon, ABS and PVC, to have the appearance of walnut wood by creating irregularly spaced grooves, optionally patterned, in the to-be-coated surface(s), starting with a base color (color of the substrate or of a base coat applied to the substrate) of light yellow (for light walnut) or brown (for dark walnut), and applying color solutions of brown (40%) and red (60%) (for light walnut appearance) or of brown (50%) and red (50%) (for dark walnut appearance), using an applicator (and saturator) implement of polyurethane foam (for light walnut or dark walnut appearance);
2. forming an ersatz maple coating using 70% brown and 30% red color solution;
3. forming an ersatz oak coating using light yellow substrate (for light oak appearance) or dark yellow substrate (for dark oak appearance), and 50/50 brown/red color (for light oak) or 70/30 brown/red (for dark oak);
4. creating a birch-like appearance using 75/20/5 brown/red/black color solutions; and
5. creating a mahogany-like appearance using 70/20/10 brown/red/black color solutions The completed article (e.g., plastic part) may be in the form of a film (veneer), as well as in the form of a substrate.

Figure 3:
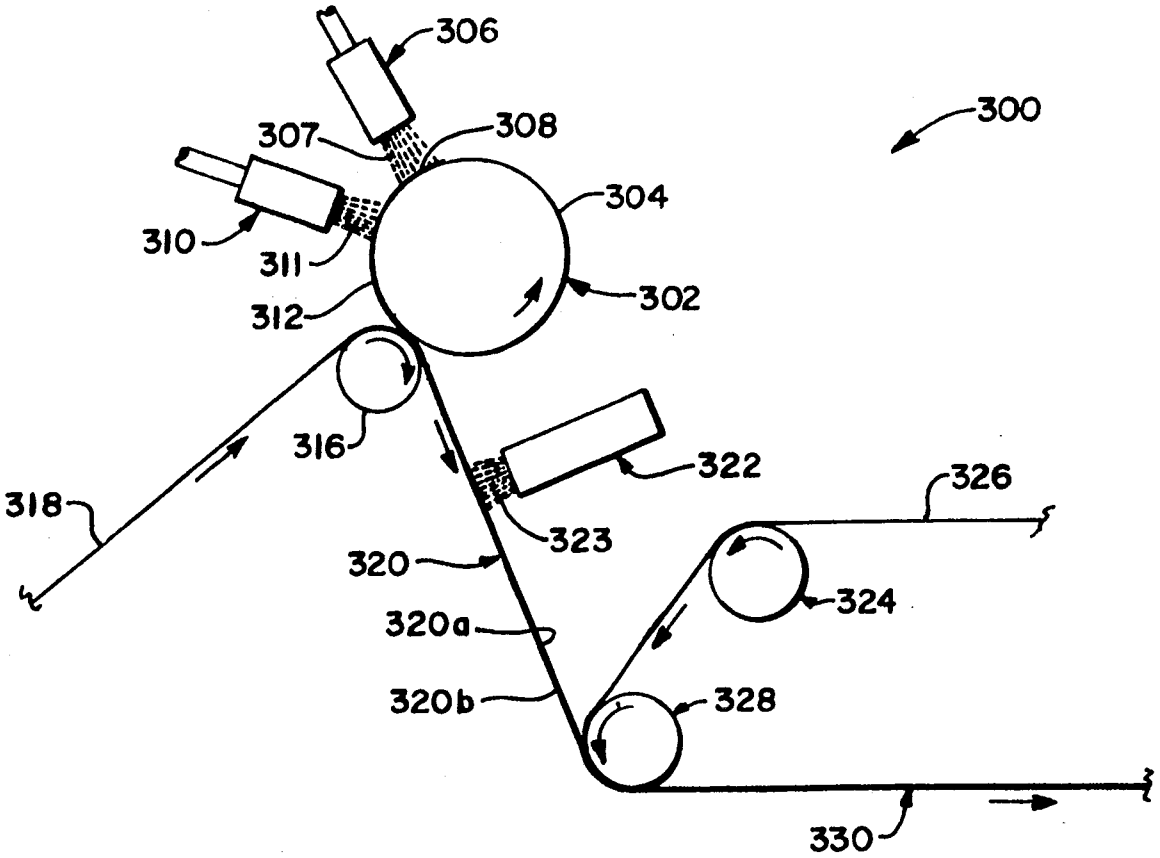
FIG. 3 is a schematic representation of a process for making a film-like article having an altered appearance, according to the present invention.

FIG. 3 is a diagram of a system 300 for making a film 330 having a desired appearance and/or texture of real wood on a top carrier 320 a removable bottom carrier 326. Several rotating wheels to produce film 330 include texture wheel 302, top carrier wheel 316, bottom carrier wheel, and wheel 328.

Coating implement 306 directs base coat solution 307 on surface texture 304 of texture wheel 302 to produce base coat 308. Heating implement 310 directs heat 311 on base coat 308. Top carrier wheel 316 supplies top carrier 318 so as to remove base coat 312 and produce film 320. Adhesive implement 322 directs adhesive 323 on back side **320*a* of film 320. Bottom carrier wheel 324 supplies a bottom carrier 326 to wheel 328. Film 320 and bottom carrier 326 are directed into wheel 328. Wheel 328 joins the bottom carrier to the back side 320*a* of film 320 to produce film 330**.

In this manner, bottom carrier 326 may be removed and 320 may be adhered to any desired substrate to produce a desired appearance.

What is claimed is:

1. A method for altering the appearance of an article formed of a material to have an appearance of at least one other material, comprising:

forming a plurality of grooves on a surface of an article, the grooves defining a surface texture on the article;

applying a surfactant solution on the surface of the article so that the grooves have a greater amount of surfactant solution than a remaining portion of the surface of the article;

applying at least one color solution on the surface of the article so that the grooves have a greater amount of a mixture of the surfactant solution and the color solution than the remaining portion of the surface of the article; and saturating the surfactant solution, color solution, and substrate color to achieve a desired concentration throughout the surface texture and obtaining a desired grain, hue or tone, and texture.

2. A method for altering the appearance of an article, according to claim 1, further comprising:

subsequently applying a top coat on the surface of the article.

3. A method for altering the appearance of an article, according to claim 1, further comprising:

prior to applying the surfactant solution, applying a base color to at least the surface of the article.

4. A method for altering the appearance of an article, according to claim 1, further comprising:

forming a first portion of the plurality of grooves on a first selected area on the surface of the article; and forming a second portion of the plurality of grooves on a second selected area on the surface of the article.

5. A method for altering the appearance of an article, according to claim 4, further comprising:

applying a first surfactant solution on the first selected area; and applying a second surfactant solution on the second selected area.

6. A method for altering the appearance of an article, according to claim 4, further comprising:

applying a first color solution on the first selected area; and applying a second color solution on the second selected area.

7. A method for altering the appearance of an article, according to claim 1, further comprising:

controlling movement of an applicator implement on the surface of the article to control applying the surfactant solution.

8. A method for altering the appearance of an article, according to claim 1, further comprising:

controlling movement of an applicator implement on the surface of the article to control applying the at least one color solution.

9. A method for altering the appearance of an article, according to claim 1, further comprising:

controlling movement of a saturator implement on the surface of the article to permeate the surfactant and color solutions into the grooves.

10. A method for altering the appearance of an article, according to claim 1, wherein:

the altered appearance is that of a naturally-occurring material.

11. A method for altering the appearance of an article, according to claim 10, wherein:

the naturally-occurring material is wood.

12. A method for altering the appearance of an article, according to claim 10, wherein:

the naturally-occurring material is leather.

13. A method for altering the appearance of an article, according to claim 1, wherein:

the altered appearance is fanciful and arbitrary.

14. Method, according to claim 1, wherein:

the article is formed of a plastic material.

15. Method of coating a substrate, comprising:

applying surfactant and color solutions to a surface of a substrate having a color;

adjusting the amount of surfactant and color solutions on the surface; and causing the surfactant and color solutions to permeate the surface by moving a saturator implement along the surface of the substrate at sufficient speed and pressure to adequately saturate and synthesize the surfactant solution, the color solution, the substrate color, and the surface texture to generate a desired at least one characteristic selected from the group consisting of grain, hue, tone, and texture on the surface of the substrate.

16. Method, according to claim 15, further comprising:

controlling moving the saturator implement along the surface of the substrate.

17. Method, according to claim 16, further comprising:

controlling moving the saturator implement with a multi-axis positioning mechanism.

18. Method, according to claim 15, further comprising:

causing the substrate, when coated, to have an appearance of a naturally-occurring material.

19. Method, according to claim 18, wherein:

the appearance is that of wood.

20. Method, according to claim 18, wherein:

the appearance is that of leather.

21. Method, according to claim 15, further comprising:

causing the substrate, when coated, to have a fanciful and arbitrary appearance.

22. A method for altering the appearance of an article formed of a first material to have an altered appearance of at least one other second material, comprising:

applying a surfactant solution on a surface of an article, said surface having a surface texture;

applying at least one color solution on the surface; and saturating the surfactant solution and color solution to achieve a desired concentration throughout the surface texture.

23. A method for altering the appearance of an article, according to claim 22 further comprising:

subsequently applying a top coat on the surface.

24. A method for altering the appearance of an article, according to claim 22 further comprising:

prior to applying the surfactant solution, applying a base color to the surface.

25. A method for altering the appearance of an article, according to claim 22, further comprising:

applying the surfactant solution with an applicator implement moving across the surface.

26. A method for altering the appearance of an article, according to claim 25, further comprising:

controlling a pressure, a speed and a direction of the applicator implement as it moves across the surface.

27. A method for altering the appearance of an article, according to claim 26, further comprising:

controlling the pressure, speed and direction of the applicator with a multi-axis positioning mechanism.

28. A method for altering the appearance of an article, according to claim 22, further comprising:

applying the at least one color solution with an applicator implement moving across the surface.

29. A method for altering the appearance of an article, according to claim 28, further comprising:

controlling a pressure, a speed and a direction of the applicator implement as it moves across the surface.

30. A method for altering the appearance of an article, according to claim 29, further comprising:

controlling the pressure, speed and direction of the applicator with a multi-axis positioning mechanism.

31. A method for altering the appearance of an article, according to claim 22, wherein:

the first material is plastic.

32. A method for altering the appearance of an article, according to claim 22, wherein:

the altered appearance is that of a naturally-occurring material.

33. A method for altering the appearance of an article, according to claim 32, wherein:

the naturally-occurring material is wood.

34. A method for altering the appearance of an article, according to claim 32, wherein:

the naturally-occurring material is leather.

35. A method for altering the appearance of an article, according to claim 22, wherein:

the altered appearance is arbitrary and fanciful.

36. Apparatus for making a plastic synthetic wood article having a desired aesthetic appearance comprising:

means for placing predetermined grooves on a surface of a plastic part, the grooves defining a surface texture, the plastic part having a selected substrate color;

means for applying a sufficient amount of a surfactant solution on the surface texture, the grooves having a greater concentration of surfactant solution;

means for applying a sufficient amount of a color solution on the surface texture, the grooves having a greater concentration of a mixture of the surfactant solution and the color solution; and means for saturating the surfactant solution, color solution, and substrate color to achieve a desired concentration throughout the surface texture and obtaining desires grain, hue or tone, and texture.

37. An apparatus for making a plastic synthetic wood article having a desired aesthetic appearance, according to claim 36, wherein:

the means for applying a sufficient amount of surfactant solution on the surface texture is an applicator.

38. An apparatus for making a plastic synthetic wood article having a desired aesthetic appearance, according to claim 36, wherein:

the means for applying a sufficient amount of the color solution on the surface texture is an applicator.

39. An apparatus for making a plastic synthetic wood article having a desired aesthetic appearance, according to claim 36, wherein:

said means for saturating the surfactant solution, color solution, and substrate color is a saturator, the saturator having sufficient amount of the surfactant solution therein.

40. An apparatus for making plastic synthetic wood articles having a desired aesthetic appearance, according to claim 37, further comprising:

means for controlling the pressure, speed, and direction of the applicator.

41. An apparatus for making plastic synthetic wood articles having a desired aesthetic appearance, according to claim 39, further comprising:

means for controlling the pressure, speed, and direction of the saturator.

42. An apparatus for making plastic synthetic wood articles having a desired aesthetic appearance, according to claim 40, wherein:

the means for controlling the pressure, speed, and direction of the applicator is a multi-axis positioning mechanism.

43. An apparatus for making a plastic synthetic wood article having a desired aesthetic appearance, according to claim 41, wherein:

the means for controlling the pressure, speed, and direction of the saturator is a multi-axis positioning mechanism.

44. An apparatus for making a plastic synthetic wood article having a desired aesthetic appearance, according to claim 36, wherein:

the grooves are irregularly spaced and have selected length, width, and depth.

45. An apparatus for making a plastic synthetic wood article, according to claim 38, further comprising:

means for controlling the pressure, speed, and direction of the applicator.

46. An apparatus for making a plastic synthetic wood article, according to claim 45, wherein:

the means for controlling the pressure, speed, and direction of the applicator is a multi-axis positioning mechanism.

47. An apparatus for making a plastic synthetic wood article, according to claim 36, further comprising:

means for applying a top coat over the surfactant solution and color solution.

* * * * *